United States Patent [19]

Suzuki et al.

[11] 4,133,422

[45] Jan. 9, 1979

[54] TYPING MACHINE

[75] Inventors: Takeo Suzuki; Ikutaro Inoue; Hideo Tamai; Masatsugu Aoki, all of Soma, Japan

[73] Assignee: Alps Electric Co., Ltd., Tokyo, Japan

[21] Appl. No.: 714,094

[22] Filed: Aug. 13, 1976

[30] Foreign Application Priority Data

Aug. 14, 1975 [JP] Japan ..... 50-98802

[51] Int. Cl.[2] ..... B41J 1/32

[52] U.S. Cl. ..... 400/154.5; 400/157.2; 400/159; 400/174; 400/317.1; 400/320; 400/470

[58] Field of Search ..... 197/1 R, 16, 48, 49, 197/52, 55, 60–65, 82, 84, 90; 101/327; 346/76 R

[56] References Cited

U.S. PATENT DOCUMENTS

| | | | |
|---|---|---|---|
| 3,168,182 | 2/1965 | Bernard et al. | 197/55 |
| 3,227,259 | 1/1966 | Howard | 197/49 |
| 3,509,980 | 5/1970 | Loughry et al. | 197/1 R |
| 3,532,204 | 10/1970 | Sasaki | 197/48 |
| 3,625,143 | 12/1971 | Nettesheim et al. | 101/327 X |
| 3,670,861 | 6/1972 | Zenner et al. | 197/64 |
| 3,848,720 | 11/1974 | Carlsen | 197/1 R |
| 3,927,753 | 12/1975 | Donovan et al. | 197/49 |
| 3,964,592 | 6/1976 | Kashio | 197/49 |

FOREIGN PATENT DOCUMENTS

| | | | |
|---|---|---|---|
| 2331194 | 6/1973 | Fed. Rep. of Germany | 197/1 R |
| 2333250 | 6/1973 | Fed. Rep. of Germany | 197/1 R |

*Primary Examiner*—Ralph T. Rader
*Attorney, Agent, or Firm*—Guy W. Shoup

[57] ABSTRACT

A simplified and compact typing machine to be incorporated in an electronic calculator has a type wheel for presenting different numerals upon rotation. The type wheel is moved along a line of digits, i.e., laterally and in the generally horizontal direction, for typing successive numerals and the typing is performed when a hammer head is swung, or the type wheel is rotated, by the movement in one direction of an acting rod of an electromagnetic relay. The same relay acting rod also laterally moves the type wheel in the direction of the line of digits, on its return motion, by a distance corresponding to the space of one digit.

9 Claims, 11 Drawing Figures

TYPING MACHINE

BACKGROUND OF THE INVENTION

The present invention is concerned with a typing machine for a type selecting apparatus of serial type, and more particularly to such a machine that is sufficiently simple in construction, for ease in manufacture, and relatively low in expense, so that it may be incorporated in an electronic desk-top calculator.

In a conventional type selecting apparatus of serial type, for example, as used in elelctric ball-element typewriters, the lateral movement of a type wheel in the direction of line of type or digits is effected by an electric motor of relatively large capacity, which renders the apparatus unacceptably large and complicated for use in a small sized electronic desk-top calculator.

Therefore, it is an objective of the present invention to overcome the above-explained shortcoming of the prior art by providing a typing machine which is simplified in construction and compact in size and can be manufactured easily at relatively low cost.

SUMMARY OF THE INVENTION

According to the present invention, there is provided a typing machine to type a line of numerical digits having a type wheel adapted to be moved in the generally horizontal direction for typing successive digits. A hammer head upon actuation, cooperates in typing with the type wheel by pressing the paper against the type wheel. An electromagnetic relay having an acting rod moves in one direction to swing the hammer head against the type wheel so that ink, supplied by the type wheel, is printed onto the interposed paper. Means are provided for converting the return movement of the acting rod to move the type wheel laterally (in the generally horizontal direction) by a distance corresponding to the space of one digit.

BRIEF DESCRIPTION OF THE DRAWINGS

The above and other objectives of the present invention, as well as other features of the invention, will become more clear from the following description of a preferred embodiment taken in conjunction with the attached drawings, in which.

DETAILED DESCRIPTION OF THE INVENTION

Figure 1:
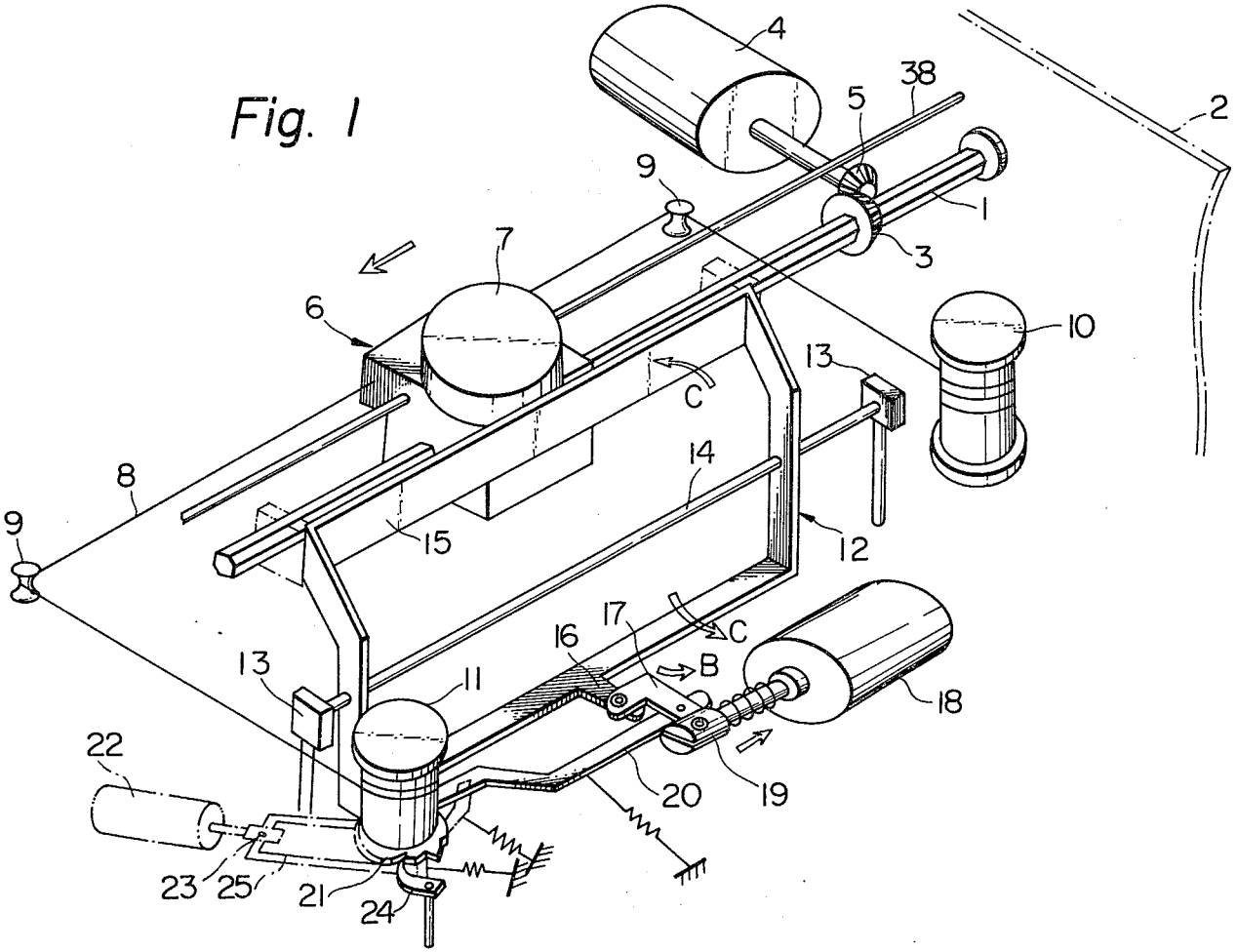
FIG. 1 is a schematic perspective view of an embodiment of the present invention.

Referring first to FIG. 1, which shows a principal construction of the typing machine of the present invention, a spline shaft 1 which is hexagonal in cross-section is rotatably supported by opposite frame members 2. For example, the frame members 2 may be the side frame members of a desk electronic calculator. A bevel gear 3 is fixed to and carried by the spline shaft 1 and engages with another bevel gear 5 which is fixed to the output shaft of a stepping motor (pulse motor) 4. The output shaft of the stepping motor will rotate an exact predetermined distance and stop when the stepping motor receives each pulse from the control and power circuit. A carriage 6 is mounted on the spline shaft for a sliding motion therealong and the carriage 6 carries a type wheel 7. A guide bar 38, having its both opposite ends affixed to the two frame members 2, passes through the carriage 6 to guide the carriage 6 during its sliding movement along the spline shaft 1. The carriage slides along both guide bars 28 and spline shaft 1 in a generally lateral (sidewise) direction.

A string 8 is fixed to the carriage 6 by means of, for example, an adhesive. The string 8 goes around two guide rollers 9 disposed at opposite sides of the carriage and is wound at each of its ends around respective take-up drums 10 and 11 so as to be tightly stretched between the drums. The center of the string is attached to the carriage; that is, the carriage is secured at about the middle of the string.

A striking frame 12 has at the center of its two opposed sides a supporting shaft 14 which is rotatably supported at each end by bearings 13 held in the side frame members. The striking frame 12 includes, as integral portions thereof, a hammer head 15 and a lower projection 16. An "L" shaped lever 17 is pivotally connected at its one end to the projection 16 of the striking frame 12 and at its other end is pivotally connected to the action rod (plunger) 19 of an electromagnetic relay 18. When relay 18 is energized, its coil (not shown) receives voltage and its action rod is withdrawn, i.e., pulled inwardly into the coil and compresses its coil spring. An arm 20 having one end fixed to the lever 17 engages at its other end with a ratchet 21 provided on the take-up drum 11. The movement of the arm 20 causes the shifting of the carriage 6, i.e. it moves (feeds) the carriage 6 in a lateral direction.

When typing is completed for one line, the carriage 6 is returned to its initial position ready for the next line of typing by the actuation of another electromagnet relay 22. The electromagnet relay 22 has an action rod (plunger) 23 which is connected to a "U" shaped member 25. The "U" shaped member disengages the arm 20 and the pawl 24 upon actuation of the relay 22.

Figure 2:
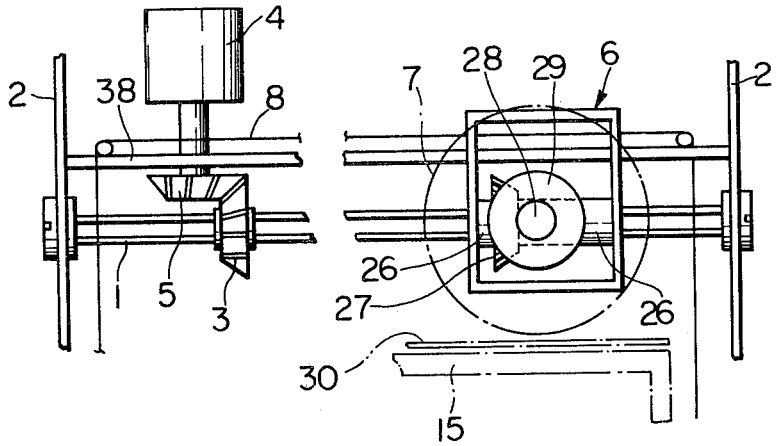
FIG. 2 is a schematic plan view of a transmission means for a type wheel.
Figure 3:
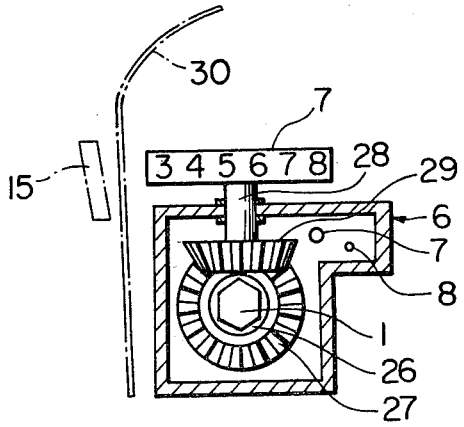
FIG. 3 is a side elevational view of the transmission means of FIG. 2.

Referring to FIGS. 2 and 3, which show the subject matter of FIG. 1 in more detail, a bevel gear 27 is housed within the carriage 6 and is fixed onto the spline shaft 1 by being cramped by spacers 26. The bevel gear 27 and the carriage 6 slide together as a unit on the shaft 1 with the movement controlled by the string 8. The bevel gear 27 meshes with the bevel gear 29 which is mounted on a shaft 28 fixed to the type wheel 7. Thus, the rotation of the spline shaft 1, which is provided by the stepping motor 4, is transmitted to the type wheel 7 through the bevel gears 27 and 29.

Figure 4:
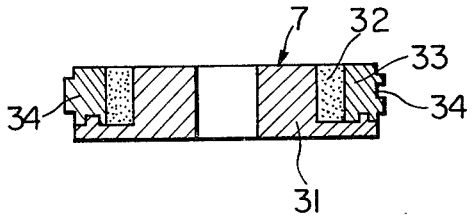
FIG. 4 is an elevational cross-sectional view of a type wheel.

The type wheel 7 is rotatably supported by the carriage 6 and is located so as to be opposite the hammer head 15 at a predetermined distance (when it is not actuated for the typing) with a paper 30 interposed. As will be seen from FIG. 4, the type wheel 7 includes a base member 31, in the form of a disk, of a synthetic resin (plastic) material, an ink-impregnated sponge 32 in the form of a ring, and a porous rubber ring 33, such as foamed polyurethane, surrounding the sponge 32. Type 34, of numerals, are formed on the outer peripheral surface of the porous rubber ring 33. As the hammer head presses the interposed paper 30 onto the type 34, the type face numeral is transferred or printed onto the paper 30, since the porous ring 33 is supplied with ink from the sponge 32. Alternatively, and not shown, the carriage 6 may be tilted, by relay 18, to strike a fixed platen.

Figure 5:
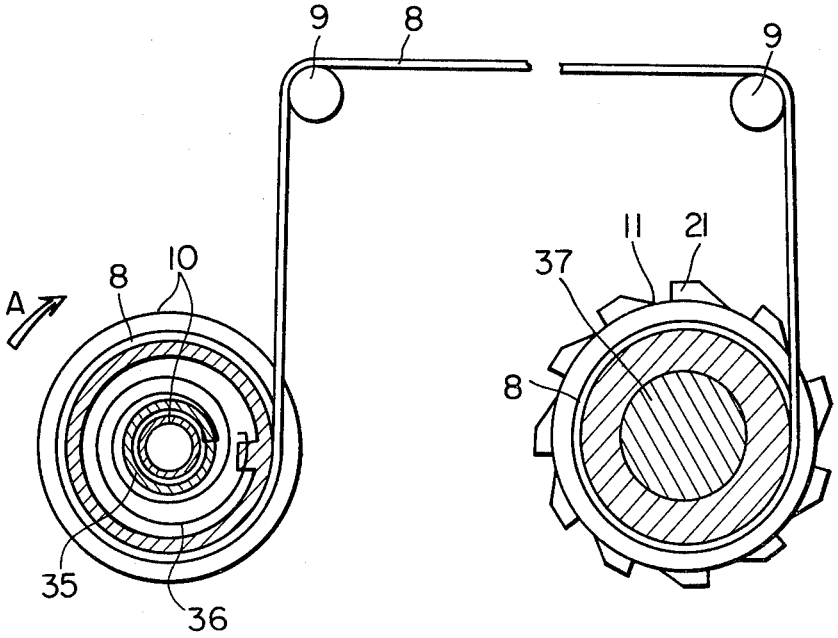
FIG. 5 is a sectional plan view of take-up drums.
Figure 6:
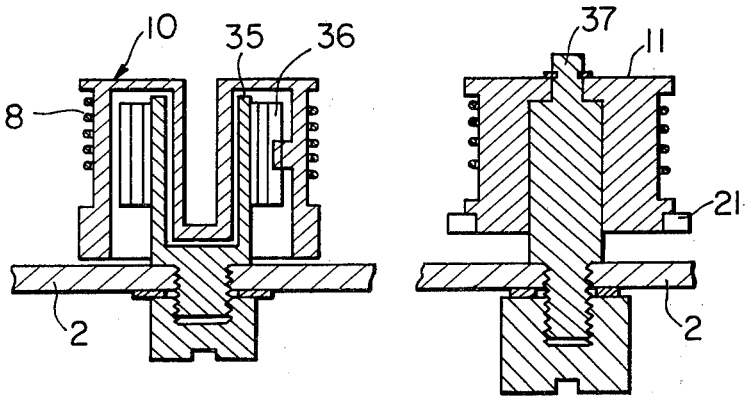
FIG. 6 is an elevational sectional view of the take-up drums of FIG. 5.

Referring now to FIGS. 5 and 6, the take-up drum 10 is carried by a hollow shaft 35 for free rotation, the hollow shaft being affixed to the frame 2. A flat coil spring 36 is provided between the hollow shaft 35 and the drum 10, with its respective opposite ends being secured to shaft 35 and drum 10. The spring 36 exerts a rotational force to rotationally urge the drum 10 in one direction upon being wound up in the opposite direction. The other take-up drum 11 is freely rotatably mounted upon a shaft 37 which is fixed to the frame. The aforementioned ratchet 21 is fixed to the lower end of the take-up drum 11.

Figure 7:
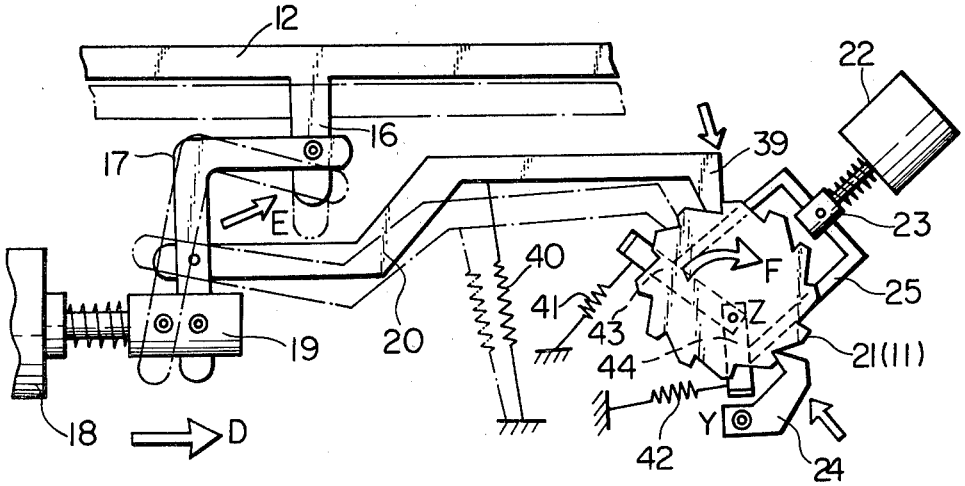
FIGS. 7 and 8 are illustrations of a mechanism interlocked with an electromagnetic plunger.
Figure 8:
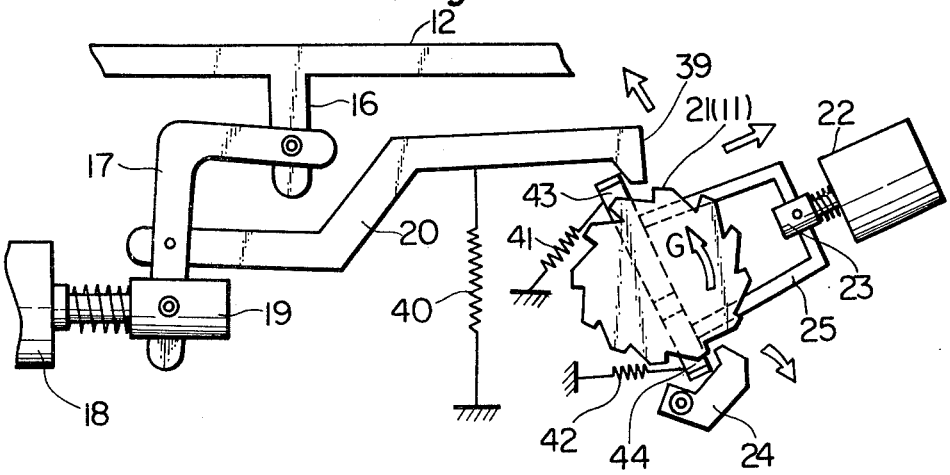

As will be seen from FIGS. 1, 7 and 8, the arm 30 has one end connected to a lever 17 which in turn is pivotally connected to the striking frame 12. At its opposite end lever 17 is pivotally connected to a "U" shaped member fixed at the end of acting rod 19. The opposite end of arm 20 has an extension 39 (see FIGS. 7 and 8) which is biased by a spring 40 so as to be engaged with the teeth of the ratchet 21. As the electromagnetic relay 18 is energized to retract the acting rod 19 from the position shown in the solid line in FIG. 7, the lever 17 pivots so that the extension 39 of the arm 20 comes in contact with a new tooth which is next to the tooth with which the end 39 had been engaged, as shown by the dash-and-dot line. The arrangement is such that, during the above operation, the rotational movement of the arm 20 as shown by the arrow B (FIG. 1) causes the rotation of the striking frame 12 around the axis of its supporting shaft 14 in the direction of an arrow C of FIG. 1, thereby causing the hammer head 15 to move toward the type wheel 7. The hammer head 15 will strike the wheel 7 when a paper is not interposed between them.

As the current supply to the relay 18 is stopped, the acting rod 19 returns (under spring force) from the position of the dash-and-dot line in the direction of an arrow D, causing a rotation of the lever 17 in the direction of an arrow E of FIG. 7, so that the extension 39 of the arm 20 advances the ratchet 21 by an angular distance corresponding to the pitch of its teeth, in the direction of an arrow F of FIG. 7. The rotation of the ratchet 21 causes a pulling force on the string 8 against the biasing force of the flat wound coil spring 36 which is exerted on the take-up drum 10, thereby causing a lateral shifting or movement of the carriage 6 by a distance corresponding to one letter or digit. The return of the acting rod 19 also causes the striking frame 12 to return in the counter direction of the arrow C (FIG. 1), so that the hammer head 15 is moved away from the type wheel 7. The pawl 24 prevents the rotation of the ratchet 21 contrary to the direction of arrow F of FIG. 7 and is always biased by a spring (not shown) toward the ratchet 21 and is adapted to pivot around a point Y so that pawl 24 disengages from the ratchet 21 as the ratchet rotates in the direction of the arrow F.

As shown in FIG. 7, levers 43 and 44 are located so as to move opposite the end of the lever 20 and the pawl 24 when desired. The lever 43 is pulled by a spring 41, while the lever 44 is biased by a spring 42, and both are connected through the "U" shaped member 25 to the acting rod 23 of the relay 22. Relay 22, as aforementioned, is adapted to be energized when a line of type has been completed. When the relay 22 is energized, the acting rod 23 rotates the levers 43, 44 around a point Z so that the arm 20 and the pawl 24 are disengaged from the teeth of the ratchet 21, as shown in FIG. 8. As the ratchet 21 is released, the take-up drum 11 is rotated by the string 8 which is pulled by the other take-up drum 10 due to the returning force exerted by the coil spring 36, causing the rotation of the ratchet 21 in the direction of an arrow G of FIG. 8. Thus, the take-up drum 10 pulls the string 8 to take it up and thereby return the carriage 6 to the initial position for the typing of the next line.

Figure 9:
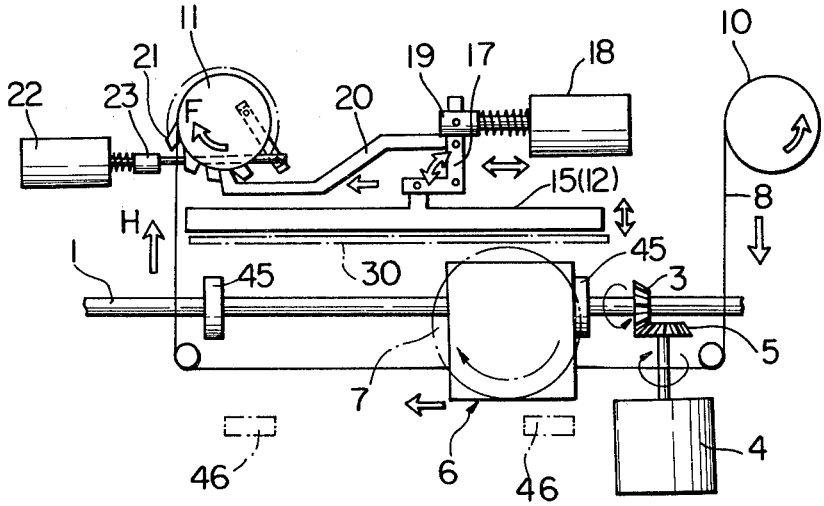
FIGS. 9 and 10 are schematic illustrations of the manner of operation of a typing mechanism.
Figure 10:
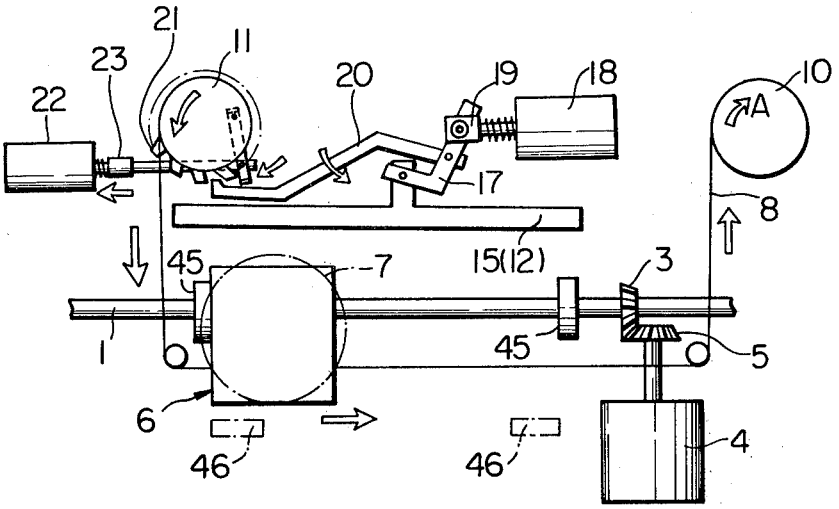
Figure 11:
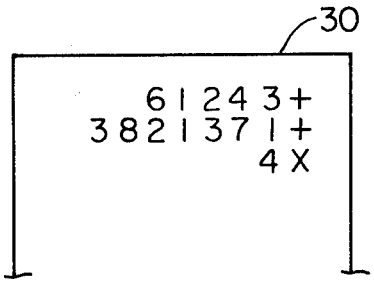
FIG. 11 is an illustration showing a manner in which numerals and symbols are typed.

Hereinafter, the manner of operation of the apparatus will be described with reference to FIGS. 9 to 11. As explained above, when a type ordering key (not shown), which may be an operation order key of an electronic calculator, is depressed, the stepping motor 4 is energized to rotate the spline shaft 1. The rotation of spline shaft 1 is transmitted to the type wheel 7 which is at its intitial position.

Due to a signal from a memory circuit of the calculating machine, which circuit remembers the numeral to be typed, the rotation of the type wheel 7 is stopped when a numeral to be typed first comes to a position opposed to the hammer head 15. In other words, the stepping motor 4 produces, under control of the calculator, the number of turns necessary to rotate the type wheel. In response to the stopping of the type wheel 7, the relay 18 is energized. The rotation of the lever 17 then causes the hammer head 15 to strike toward the type wheel 7, thereby typing the first numeral onto the paper 30. After the first numeral is typed, the acting rod 19 of the relay 18 is returned to rotate the lever 17 thereby to move the hammer head 15 away from the type wheel. At the same time, the arm 20 which is connected to the lever 17 acts to rotate the ratchet 21 and accordingly the take-up drum 11, in the direction of the arrow F of FIG. 9. This rotation of the take-up drum 11 causes the lateral shifting of the string 8 in the direction of an arrow H (FIG. 9) so that the carriage 6 is moved horizontally by a distance corresponding to one digit. The type wheel 7 is rotated by the stepping motor to its initial rotational set position, as it is moved along the carriage 6 after the typing, and repeats the typing and the lateral movement in response to the electrical pulse signal issued from the memory circuit.

As the type wheel 7 passes the last typing position of the line, the carriage 6 comes to abut a stopper 45, which is detected by detecting means 46. Upon receipt of a signal from the detecting means 46, the electromagnet plunger 22 acts to release the ratchet 21 in the manner as explained above, so that the string 8 is taken up by the drum 10, as shown by an arrow A of FIG. 10, by the force exerted by the coil spring 36 which is housed by the drum 10. It will be understood that the taking up of the string 8 by the take-up drum 10 causes the returning of the carriage 6 and of the type wheel 7 to the initial position.

During this returning of the type wheel to the initial position, paper feeding means (not shown) feeds or advances the paper 30 by a distance corresponding to one space, i.e., the spacing of one line from the next line. The returning of the carriage 6 to the initial position is detected by another detecting means 26, for example, a small switch or an electromagnetic pick-up transducer, which is located at the initial position, which detecting means then issues a signal to cut the current supply to the electromagnet plunger 22. The acting rod 23 is then returned so that the lever 20 and the pawl 24 again come to restrain the ratchet 21. The typing machine is then ready for the typing of the next line, as shown in FIG. 9.

As described in the typing machine of the invention, the type wheel is adapted to move in a horizontal direction for the typing of successive numerals and electromagnetic relays or plungers are used to perform the striking or locating functions. The returning motion of the relay plunger causes the lateral movement of the type wheel in the horizontal direction by a distance corresponding to the space of one digit.

Thus, unlike the conventional apparatus, it is unnecessary to employ an electric motor for the lateral movement of the type wheel because the lateral moving or feeding of the type wheel is conveniently performed by making use of the electromagnetic relay for effecting the typing.

Since the motor for the lateral movement of the type wheel and its associated mechanism are dispensed with, the typing machine of the invention is significantly simplified in construction. The present invention thus provides a typing machine which is more compact and more easily manufactured than conventional typing machines and which can be suitably incorporated into electronic desk-top calculators.

It is possible to modify the embodiment without departing from the spirit of the invention. In the described invention, the typing is made from the right-hand side end of a line as viewed in FIG. 11 toward the left-hand side end. Thus, after the typing of the required number of digits, the type wheel continues to move toward the end of the line, i.e., the left-hand side end, repeating so-called "spacing motion." However, it is possible to incorporate a digit-number control circuit so that the type wheel may be returned directly to the initial position of line, after the typing of the required number of digits for a line, without taking the step of returning to the end position by the repeated spacing.

It will be clear to those skilled in the art that many changes and modifications are possible within the scope of the invention which is limited solely by the appended claims.

What is claimed is:

1. A typing machine comprised of:

a type wheel which is movable laterally across a line of type;

means for rotating said type wheel;

a hammer head means with an elongated hammer head, said hammer head extending across said line of type and being laterally non-movable; a shaft rotatably supporting said hammer head means for pivotable movement of said hammer head means;

electromagnetic relay means connected to said hammer head means and comprising a single electromagnetic relay and which upon actuation advances the type wheel laterally and moves said hammer head means;

said hammer head means being connected to said electromagnetic relay moving means such that when said moving means moves in one direction said hammer head means pivots about said shaft and said hammer head strikes toward said type wheel, and when said electromagnetic relay moves in the opposite direction said moving means causes the lateral advance of said type wheel and said hammer head means pivots about said shaft and removes said hammer head away from said type wheel.

2. A typing machine as claimed in claim 1, wherein said type wheel comprises a base, an ink-impregnated porous material mounted on said base, and a porous ring with type formed on its exterior, wherein printing is effectuated on paper interposed between said type wheel and said hammer head upon actuation of said electromagnetic relay means.

3. A typing machine as claimed in claim 1 and further comprising a carriage upon which said type wheel is rotatably mounted; a string connected at its intermediate portion to said carriage; two rotatably mounted take-up drums each of which are located at opposite ends of said string and connected to said string; spring means to bias at least one of said take-up drums and to allow lateral movement of said carriage; means to rotate said take-up drums to move said carriage the space of a digit; and means to return said carriage to its initial position after the typing of a line has been completed.

4. A typing machine for a type selecting apparatus as claimed in claim 3, wherein said means to rotate said take-up drum comprises a ratchet fixed to said take-up drum, a pawl biased against said ratchet, and an arm which is connected to said moving means of said electromagnetic relay and which is also in contact with and drives said ratchet, wherein when said moving means actuates said arm, it drives a tooth of said ratchet.

5. A typing machine as in claim 4 wherein said take-up drums rotate to move said carriage laterally; and wherein said means to return said carriage to its initial position after the typing of a line has been completed further comprises a second electromagnetic relay which is energized when a line of type has been completed, a first lever means and a second lever means which upon movement disengages said arm from said ratchet and also disengages said pawl from said ratchet.

6. A typing machine as in claim 5 and further including spring means biasing said first and second lever means away from said ratchet and a U-shaped bar connecting said first and second lever means to said second relay, wherein when said second relay is energized said U-shaped bar pulls said first and second lever means, hence disengaging said ratchet and allowing said take-up drums to return to their initial position, thus allowing said carriage to return to its initial position.

7. A typing machine as claimed in claim 1, further comprising a carriage slidable on a bar, with said type wheel mounted on said carriage and further comprising a stepping motor; a spline shaft to said carriage through and upon which said carriage is slidable, first bevel gear means fixed on said spline shaft and said type wheel and second bevel gear means fixed on the output shaft of said stepping motor and said spline shaft, wherein the rotation of said stepping motor is transmitted to said type wheel means by said spline shaft and by said first and second bevel gear means.

8. A typing machine as in claim 1 wherein said moving means is the plunger of said relay.

9. A typing machine which selects type in a serial manner comprised of:

a type wheel;

a hammer head means;

electromagnetic relay means connected to said hammer head means and comprising a single electromagnetic relay and which upon actuation advances the type wheel laterally and moves said hammer head means and said type wheel to strike each other, said electromagnetic relay means having moving means which when moving in one direction strikes said hammer head means and said type wheel together and which when moving in the opposite direction causes the lateral advance of said type wheel;

a type wheel means carrying said type wheel and moved in the direction of line of type for typing of successive digits, said type wheel means comprising a string means having a portion connected to said type wheel means and wound at one of its ends around a take-up drum so as to effect the movement of said type wheel means in said direction of the line of type upon said string being taken onto said take-up drum by a distance corresponding to the space of a digit and spring means adapted to bias said type wheel means opposite to the take up of said string;

means to rotate said take-up drum and comprising a ratchet fixed to said take-up drum, a pawl biased against said ratchet, and an arm means which is connected to said moving means of said electromagnetic relay and which is also in contact with and drives said ratchet wherein when said moving means actuates said arm means it drives a tooth of said ratchet; and means to return said carriage to its initial position after the typing of a line has been completed comprising a second electromagnetic relay which is energized when a line of type has been completed and a lever means connected to and operated by said second electromagnetic relay and which upon movement disengages said pawl from said ratchet and permitting said spring means to return said carriage to its initial position.

* * * * *